US006378333B1

(12) United States Patent
Dray

(10) Patent No.: US 6,378,333 B1
(45) Date of Patent: Apr. 30, 2002

(54) CRYOGENIC SYSTEM FOR PRODUCING XENON EMPLOYING A XENON CONCENTRATOR COLUMN

(75) Inventor: James Robert Dray, Buffalo, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/784,012

(22) Filed: Feb. 16, 2001

(51) Int. Cl.[7] ..... F25J 3/00
(52) U.S. Cl. ..... 62/648; 62/925
(58) Field of Search ..... 62/925, 648, 646, 62/643

(56) References Cited

U.S. PATENT DOCUMENTS 3,596,471 A * 8/1971 Streich ..... 62/643
4,401,448 A * 8/1983 LaClair ..... 62/925
4,568,528 A * 2/1986 Cheung ..... 423/262
4,574,006 A * 3/1986 Cheung ..... 62/925
4,647,299 A 3/1987 Cheung ..... 62/22
4,805,412 A * 2/1989 Colley et al. ..... 62/643
5,067,976 A * 11/1991 Agrawal et al. ..... 62/643
5,069,698 A * 12/1991 Cheung et al. ..... 62/643
5,186,007 A * 2/1993 Takano et al. ..... 62/925
5,265,429 A 11/1993 Dray ..... 62/41
6,164,089 A * 12/2000 Sweeny et al. ..... 62/648

* cited by examiner

*Primary Examiner*—William C. Doerrler
(74) *Attorney, Agent, or Firm*—Stanley Ktorides

(57) ABSTRACT

A system for producing xenon concentrate suitable for further refining wherein a xenon concentrator column processes liquid from the sump of a lower pressure column and additionally produces oxygen gas for recovery or recycle to the lower pressure column.

8 Claims, 2 Drawing Sheets

CRYOGENIC SYSTEM FOR PRODUCING XENON EMPLOYING A XENON CONCENTRATOR COLUMN

TECHNICAL FIELD

This invention relates generally to cryogenic rectification and, more particularly, to cryogenic rectification for producing xenon.

BACKGROUND ART

Recent medical and aerospace advances are increasing the demand for xenon. Existing methods for producing xenon, wherein the xenon is a by product of krypton production, are relatively expensive. Xenon exists in the air at a concentration of only about 0.087 ppm. In attempting to maximize rare gas production the constraints imposed often had a negative impact on the overall plant design, effectively reducing the recovery of oxygen, by requiring an additional oxygen feed to the xenon processing unit.

Accordingly it is an object of this invention to provide a system which can produce a xenon concentrate, suitable for further processing to produce high purity xenon, without imposing a production burden on the overall cryogenic air separation plant.

SUMMARY OF THE INVENTION

The above and other objects, which will become apparent to those skilled in the art upon a reading of this disclosure, are attained by the present invention, one aspect of which is:

A method for producing xenon concentrate comprising:

(A) passing feed air into a cryogenic air separation plant having a higher pressure column and a lower pressure column, and separating the feed air by cryogenic rectification within the cryogenic air separation plant to produce oxygen-rich liquid having a xenon component;

(B) passing oxygen-rich liquid from the sump of the lower pressure column into the upper portion of a xenon concentrator column;

(C) separating the oxygen-rich liquid within the xenon concentrator column by cryogenic rectification to produce oxygen gas and xenon-richer liquid oxygen;

(D) withdrawing oxygen gas from the upper portion of the xenon concentrator column; and (E) recovering xenon-richer liquid oxygen from the lower portion of the xenon concentrator column.

Another aspect of the invention is:

Apparatus for producing xenon concentrate comprising:

(A) a cryogenic air separation plant having a higher pressure column and a lower pressure column, and means for passing feed air into the cryogenic air separation plant;

(B) a xenon concentrator column having a bottom reboiler, and means for passing liquid from the sump of the lower pressure column into the upper portion of the xenon concentrator column;

(C) means for passing fluid to the bottom reboiler and means for withdrawing fluid from the bottom reboiler;

(D) means for withdrawing gas from the upper portion of the xenon concentrator column; and (E) means for recovering xenon-richer liquid oxygen from the lower portion of the xenon concentrator column.

As used herein the term "oxygen gas" means a gas having an oxygen concentration of at least 90 mole percent.

As used herein the term, "column", means a distillation or fractionation column or zone, i.e., a contacting column or zone wherein liquid and vapor phases flow countercurrently to effect separation of a fluid mixture, as for example, by contacting of the vapor and liquid phases on a series of vertically spaced trays or plates mounted within the column and/or on packing elements. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al., page 13-3, The Continuous Distillation Process. The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures. Distillation is the separation process whereby heating of a liquid mixture can be used to concentrate the volatile component(s) in the vapor phase and the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and includes integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin.

As used herein the terms "upper portion" and "lower portion" mean those sections of a column respectively above and below the mid point of the column.

As used herein the term "indirect heat exchange" means the bringing of two fluids into heat exchange relation without any physical contact or intermixing of the fluids with each other.

As used herein the term "sump" means that section of a column below the column mass transfer internals, i.e. trays or packing.

As used herein the term "feed air" means a mixture comprising primarily oxygen and nitrogen, and also containing xenon, such as ambient air.

As used herein the term "xenon concentrator column" means a column which processes a feed containing xenon, and produces a xenon concentrate which has a higher xenon concentration than does the feed to the column.

As used herein the term "bottom reboiler" means a heat exchange device that generates column upflow vapor from column liquid.

As used herein the term "product boiler" means a heat exchanger wherein liquid from a cryogenic air separation plant, typically at increased pressure, is totally or partially vaporized by indirect heat exchange with feed air.

DETAILED DESCRIPTION

Figure 1:
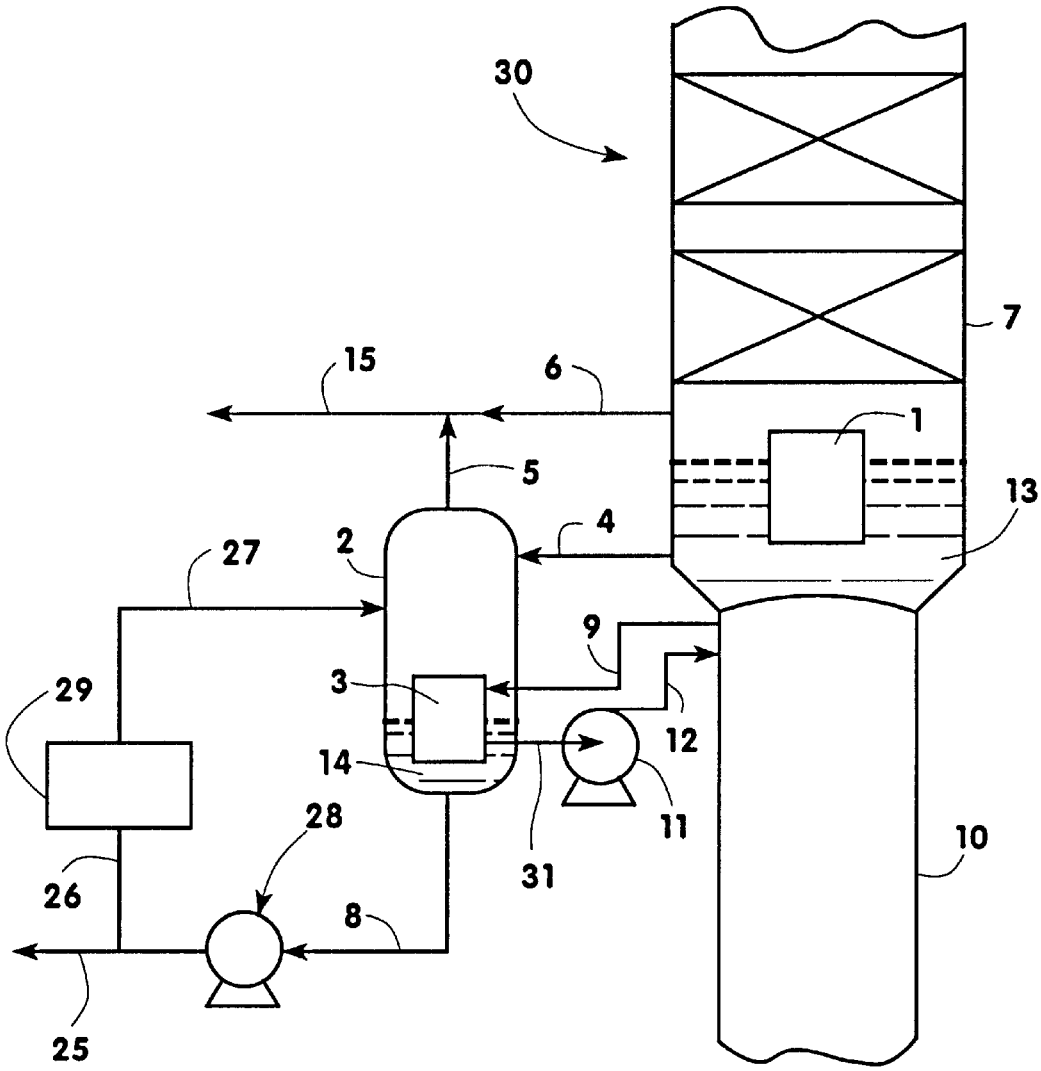
FIG. 1 is a schematic representation of one preferred embodiment of the cryogenic xenon concentration system of the invention.

The invention will be described in greater detail with reference to the Drawings. The operation of the higher pressure column and the lower pressure column of the cryogenic air separation plant used in the practice of this invention is conventional and will be described briefly and generally. The Drawings illustrate in partial view cryogenic air separation plant 30 having a higher pressure column 10 and a lower pressure column 7. The upper portion of column 7 and the lower portion of column 10, which are not germane to the present invention, are cut off in the Drawings and not illustrated.

Referring now to FIG. 1, feed air which has been cleaned of high boiling impurities such as carbon dioxide, water vapor and hydrocarbons, is cooled and compressed and passed into higher pressure column 10 of cryogenic rectification plant 30. If desired, a portion of the feed air may be turboexpanded and passed into lower pressure column 7 of cryogenic air separation plant 30. First or higher pressure column 10 is operating at a pressure generally within the range of from 60 to 150 pounds per square inch absolute (psia). Within higher pressure column 10 the feed air is separated by cryogenic rectification into oxygen-enriched liquid and nitrogen-enriched vapor. Oxygen-enriched liquid is withdrawn from the lower portion of column 10 and ultimately passed into column 7. Nitrogen-enriched vapor is passed from higher pressure column 10 into main condenser 1 wherein it is condensed by indirect heat exchange with oxygen-rich liquid 13 in the sump of column 7. A portion of the resulting nitrogen-enriched liquid is returned to column 10 as reflux and another portion of the resulting nitrogen-enriched liquid is passed into column 7.

Second or lower pressure column 7 is operating at a pressure less than that of higher pressure column 10 and generally within the range of from 15 to 50 psia. Within lower pressure column 7 the various feeds into that column are separated by cryogenic rectification into nitrogen-rich vapor and oxygen-rich liquid. The nitrogen-rich vapor is withdrawn from the upper portion of lower pressure column 7 and may be recovered in whole or in part as product nitrogen.

Oxygen-rich liquid 13 has an oxygen concentration generally within the range of from 90 to 99.9 mole percent and also contains xenon in a concentration generally within the range of from 0.5 to 60 ppm. Oxygen-rich liquid is passed from the sump of lower pressure column 7 in stream 4 into the upper portion of xenon concentrator column 2 wherein it is separated by cryogenic rectification into oxygen gas and xenon-richer liquid oxygen. The xenon-richer liquid oxygen 14 collects in the sump of column 2 and is boiled therein by operation of reboiler 3 which is driven by nitrogen-enriched vapor from higher pressure column 10. Nitrogen-enriched vapor from the upper portion of higher pressure column 10 is passed in stream 9 into reboiler 3 wherein it is condensed by indirect heat exchange with the aforesaid boiling xenon-richer liquid oxygen. Condensed nitrogen-enriched liquid is withdrawn from reboiler 3 in stream 31, passed through pump 11 and then in stream 12 returned to the upper portion of higher pressure column 10. Pump 11 can be eliminated by returning stream 12 to a stage below the top of column 10 or by throttling stream 12 to a lower pressure vessel such as column 7. The heat exchange in the sump of column 2 causes vapor to flow upward from the sump up through column 2 in countercurrent flow to the downflowing oxygen-rich liquid passed into the column in stream 4. The more volatile oxygen preferentially passes into the upflowing vapor while the less volatile xenon preferentially remains in the downflowing liquid. The resulting oxygen gas is withdrawn from the upper portion of xenon concentrator column 2 in stream 5. In the embodiment of the invention illustrated in FIG. 1, oxygen gas in stream 5 is combined with stream 6 which comprises vaporized oxygen-rich liquid from the sump of column 7, and the combined oxygen gas stream 15 is recovered as product oxygen. The resulting xenon-richer liquid oxygen 14 in the sump of xenon concentrator column 2, which has undergone an increase in xenon concentration by virtue of the oxygen depletion of the downflowing liquid within column 2 as well as by virtue of the boiling taking place in the sump of column 2 which preferentially boils off oxygen as opposed to xenon, is withdrawn from the lower portion of xenon concentrator column 2 in stream 8 and recovered. Typically the xenon concentration of the xenon-richer liquid oxygen in stream 8 is within the range of from 50 to 500 ppm. The liquid in stream 8 is typically passed to a xenon refinery for the production of high purity xenon.

An adsorber trap can be included in the system to control the concentration of undesirable impurities within the reboiler sump liquid 14. An internal gel trap is the simplest solution, but space restrictions may limit the quantity of adsorbent that can be used. FIG. 1 illustrates an external trap system. Xenon-richer liquid oxygen 8 is withdrawn from the sump of column 2 and increased in pressure as it flows through pump 28. The flow from pump 28 splits into stream 25 which flows, for example, to storage, and into stream 26 which flows through adsorbent trap 29. Stream 27 flows from trap 29 into column 2. The configuration has advantages in improved trap life and in reduced product loss, albeit with some added complexity due to the use of pump 28 and additional controls. The two configurations, i.e. internal and external adsorber traps, are more effective than adding an adsorbent trap to stream 4 because of the low concentration of the contaminants and the long mass transfer front.

Figure 2:
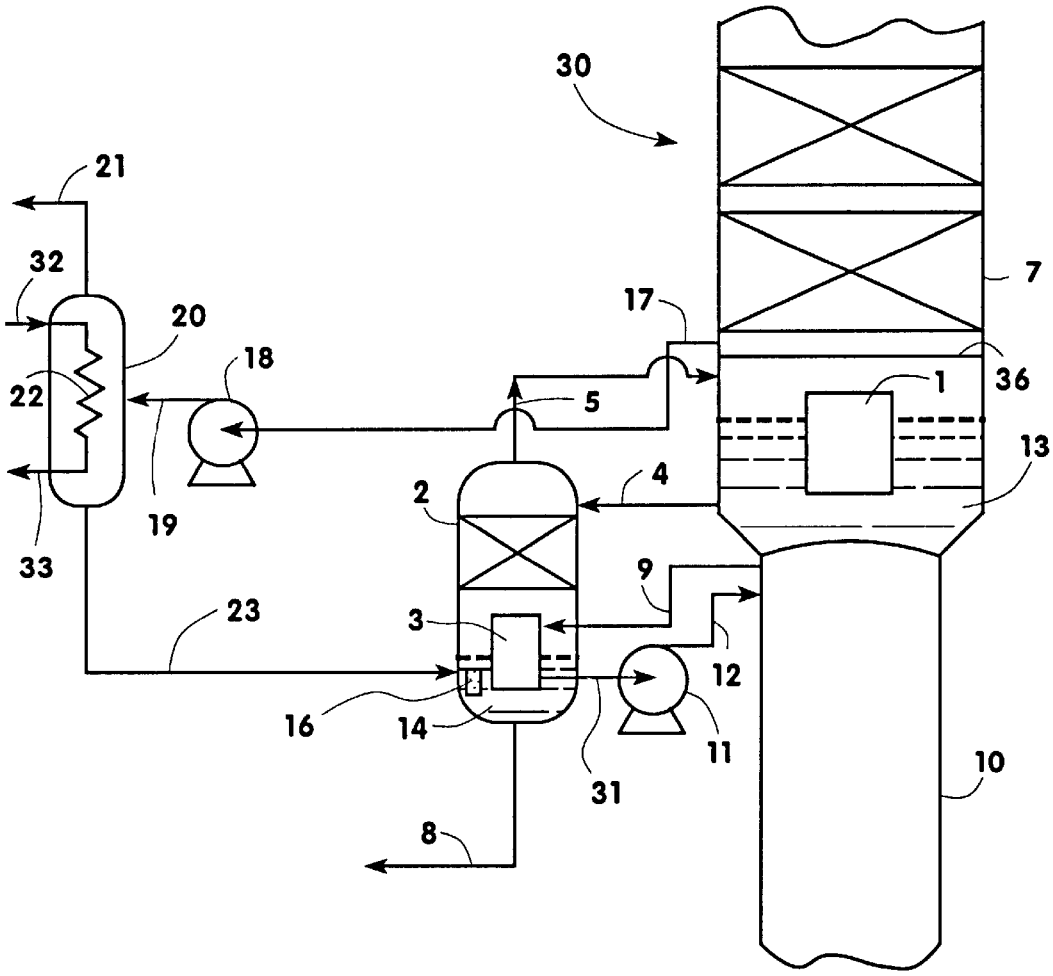
FIG. 2 is a schematic representation of another preferred embodiment of the cryogenic xenon concentration system of the invention.

FIG. 2 illustrates another embodiment of the invention wherein liquid oxygen is withdrawn from the lower pressure column 7. The numerals of FIG. 2 are the same as those of FIG. 1 for the common elements and the elements of the embodiment illustrated in FIG. 2 which are common with the embodiment illustrated in FIG. 1 will not be described again in detail.

Referring now to FIG. 2, a portion of the cleaned, cooled and compressed feed air is passed through heat exchanger 22 in product boiler 20 wherein it is at least partially condensed. The resulting feed air 33 is then passed into the lower portion of higher pressure column 10 and/or lower pressure column 7. Oxygen gas withdrawn from the upper portion of xenon concentrator column 2 in stream 5 is passed into the lower portion of lower pressure column 7. A portion 17 of the oxygen-rich liquid taken from liquid collector 36 just above main condenser 1 of lower pressure column 7 is not passed into xenon concentrator column 2 but, rather, is pumped to a higher pressure, generally within the range of from 30 to 1000 psia, by passage through liquid pump 18. The pump discharge flow 19 is fed to liquid storage and/or to a heat exchanger where it is vaporized by indirect heat exchange such as with air or nitrogen. When the product boiler arrangement illustrated in FIG. 2 is employed, stream 19 is passed to the product boiler.

Referring back now to FIG. 2, resulting pressurized oxygen-rich liquid in stream 19 is passed into product boiler 20 wherein it is partially vaporized by indirect heat exchange with the at least partially condensing feed air 32. Nitrogen may also be used for this heat exchange. The resulting oxygen-rich vapor is withdrawn from product boiler 20 in stream 21 and recovered as product oxygen. If a pool boiling configuration is used, the remaining oxygen-rich liquid is withdrawn from product boiler 20 in stream 23 and passed into xenon concentrator column 2, preferably, as illustrated in FIG. 2, into the sump of xenon concentrator column 2, thereby making the xenon content within this fluid available for recovery as part of the xenon-richer liquid oxygen produced by xenon concentrator column 2. The xenon concentrator column shown in FIG. 2 employs an internal gel trap 16 as the adsorber trap.

Although the invention has been described in detail with reference to preferred embodiments, those skilled in the art will recognize that there are other embodiments of the invention within the spirit and the scope of the claims. For example, the cryogenic air separation plant may include an argon sidearm column for the production of argon, in addition to the higher pressure and lower pressure columns for the production of oxygen and nitrogen illustrated in the Drawings.

What is claimed is:

1. A method for producing xenon concentrate comprising:

(A) passing feed air into a cryogenic air separation plant having a higher pressure column and a lower pressure column, and separating the feed air by cryogenic rectification within the cryogenic air separation plant to produce oxygen-rich liquid having a xenon component;

(B) passing oxygen-rich liquid from the sump of the lower pressure column into the upper portion of a xenon concentrator column;

(C) separating the oxygen-rich liquid within the xenon concentrator column by cryogenic rectification to produce oxygen gas and xenon-richer liquid oxygen;

(D) withdrawing oxygen gas from the upper portion of the xenon concentrator column; and (E) recovering xenon-richer liquid oxygen from the lower portion of the xenon concentrator column and wherein some oxygen-rich liquid from the lower pressure column is pressurized and then partially vaporized by indirect heat exchange with a portion of the feed air.

2. The method of claim 1 wherein oxygen gas withdrawn from the upper portion of the xenon concentrator column is recovered as product oxygen.

3. The method of claim 1 wherein oxygen gas withdrawn from the upper portion of the xenon concentrator column is passed into the lower pressure column.

4. The method of claim 1 wherein oxygen-rich liquid remaining after the indirect heat exchange with a portion of the feed air is passed into the lower portion of the xenon concentrator column.

5. Apparatus for producing xenon concentrate comprising:

(A) a cryogenic air separation plant having a higher pressure column and a lower pressure column, and means for passing feed air into the cryogenic air separation plant;

(B) a xenon concentrator column having a bottom reboiler, and means for passing liquid from the sump of the lower pressure column into the upper portion of the xenon concentrator column;

(C) means for passing fluid to the bottom reboiler and means for withdrawing fluid from the bottom reboiler;

(D) means for withdrawing gas from the upper portion of the xenon concentrator column; and (E) means for recovering xenon-richer liquid oxygen from the lower portion of the xenon concentrator column and further comprising a product boiler, means for passing feed air to the product boiler, and means for passing feed air from the product boiler into the cryogenic air separation plant.

6. The apparatus of claim 5 wherein the means for withdrawing gas from the upper portion of the xenon concentrator column additionally communicates with the lower pressure column.

7. The apparatus of claim 6 further comprising means for passing fluid from the lower pressure column to the product boiler and means for passing fluid from the product boiler to the xenon concentrator column.

8. The apparatus of claim 6 further comprising an adsorbent trap and means for passing liquid in the sump of the xenon concentrator column through the adsorbent trap.

* * * * *